US006865766B2

(12) United States Patent
Pettersson

(10) Patent No.: US 6,865,766 B2
(45) Date of Patent: Mar. 15, 2005

(54) PROCESS TAPPING POINT CLEARING APPARATUS

(75) Inventor: Carl James Pettersson, Rockingham (AU)

(73) Assignees: Hans Sauer and Sons Pty Ltd, Georges Terrace (AU); 3EKP Pty Ltd, Georges Terrace (AU)

( * ) Notice: Subject to any disclaimer, the term of this patent is extended or adjusted under 35 U.S.C. 154(b) by 319 days.

(21) Appl. No.: 10/110,488

(22) PCT Filed: Nov. 6, 2001

(86) PCT No.: PCT/AU01/01425

§ 371 (c)(1),
(2), (4) Date: Apr. 30, 2002

(87) PCT Pub. No.: WO02/36276

PCT Pub. Date: May 10, 2002

(65) Prior Publication Data

US 2003/0019058 A1 Jan. 30, 2003

(30) Foreign Application Priority Data

Nov. 6, 2000 (AU) ..... PR 1258

(51) Int. Cl.[7] ..... B08B 9/027

(52) U.S. Cl. ..... 15/104.05; 15/104.03; 15/104.16

(58) Field of Search ..... 15/104.31, 104.33, 15/104.16, 104.05, 104.03

(56) References Cited

U.S. PATENT DOCUMENTS

| | | | | | |
|---|---|---|---|---|---|
| 1,467,492 | A | * | 9/1923 | Olson | 137/245.5 |
| 4,312,679 | A | * | 1/1982 | Klein, Sr. | 134/8 |
| 4,391,289 | A | * | 7/1983 | Adams | 137/15.07 |
| 4,476,603 | A | * | 10/1984 | Lukaszewicz | 15/104.31 |
| 5,745,948 | A | * | 5/1998 | Lloyd et al. | 15/104.12 |
| 5,862,561 | A | | 1/1999 | Irwin | |

FOREIGN PATENT DOCUMENTS

| | | |
|---|---|---|
| JP | 2000-061417 | 2/2000 |
| WO | WO 96/32603 | 10/1996 |

* cited by examiner

*Primary Examiner*—Randall Chin
(74) *Attorney, Agent, or Firm*—Baker & Daniels

(57) ABSTRACT

An apparatus for clearing a process tapping point including a clearing head 3 adapted to pass through the process tapping point to remove scale and/or debris material therefrom, actuation means 7 for driving the clearing head in a reciprocal motion through said process tapping point; and wherein the clearing head 3 includes a flow path through which purge fluid can pass.

21 Claims, 9 Drawing Sheets

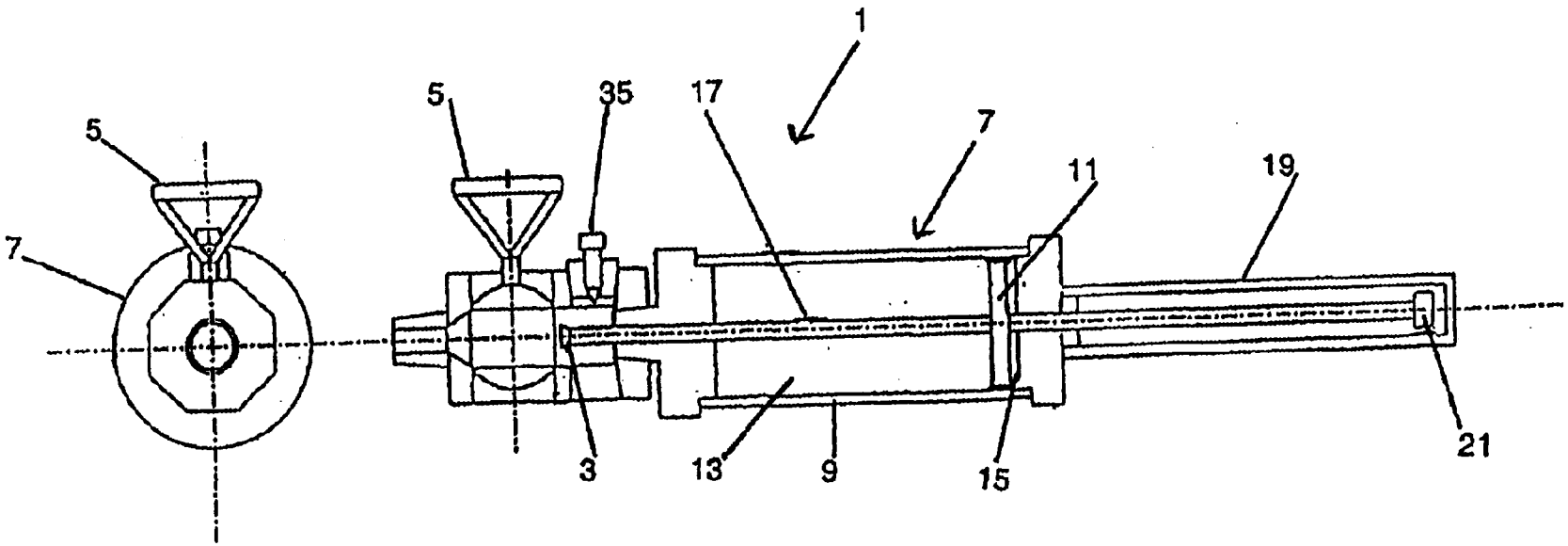
Figure 1a
Figure 1b
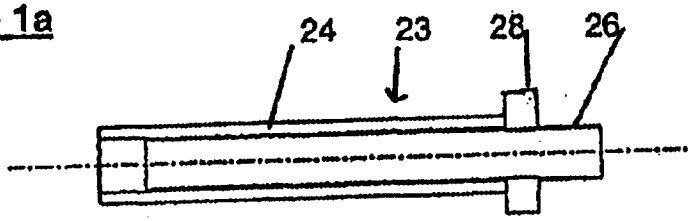
Figure 2

PROCESS TAPPING POINT CLEARING APPARATUS

BACKGROUND OF THE INVENTION

The present invention is generally directed to process measurement systems used in the mineral, chemical and food processing industries, and in particular to an apparatus for clearing process tapping points.

The processing industry relies upon the accurate measurement of process variables to enable the optimal control of their refining or manufacturing processes. One of the most common methods of taking various process measurements is via process tapping points exposed to the interior contents of a process vessel or pipeline.

Such tapping points encounter progressive scaling or debris build-up over time within their internal bore. The restriction or blockage of process tapping points by scaling or debris build-up can cause inaccurate process measurement, inaccurate product sampling or even render the process measurement completely unavailable.

Therefore, when process tapping points are blocked or restricted to the point of affecting the accuracy of the process measurement, they need to be cleared.

Current method for the clearance of process tapping points includes the manual removal of the blocking material using manual or power tools whilst the process is online. This can however be a highly hazardous operation for even the most experienced operators. This is because of the hazardous nature of most process fluids.

Another method used to maintain the clearance of the process tapping points is the introduction of a purge fluid through the tapping points. This purge fluid passes continuously through the tapping point keeping it clear of any scaling or debris. The disadvantage of this method is that it adds a large amount of inert media to the process fluid that must later be extracted at significant expense to maintain process efficiency. Further, the introduction of purge fluid through the tapping point does not stop the tapping point blocking, but merely delays the blocking. Thus another way of preventing the blockage is to provide larger diameter tapping points so that the time taken to block is longer.

Large oversize process connections have also been utilised to provide for longer periods where accurate process measurements can be obtained. This arrangement however merely delays the inevitable need to clear the process tapping points. Oversize process connections are also more expensive to install than conventional connections.

Although described with reference to process industry it would be clear to a person skilled in the art that the present invention has applicability to a number of industries where access is required to a pipe or vessel that scales during use.

SUMMARY OF THE INVENTION

It is therefore an object of the present invention to provide an apparatus for reducing or eliminating the need to periodically clear the process tapping points.

With this in mind, there is provided a process tapping point clearing apparatus including:

a clearing head adapted to pass through a process tapping point for removing scaling and/or debris material therefrom; and actuation means for driving the clearing head in a reciprocal motion through said process tapping point;

wherein the clearing head includes a flow path through which purge fluid can pass.

The flow path of the clearing head may be provided by an internal cavity through which purge fluid may flow therethrough. The cavity may have an opening at the end of the clearing head. At least one aperture may pass through from the exterior of the clearing head to the interior cavity to allow the purge fluid to pass through the aperture into the cavity and out of the opening at the end of the clearing head. Preferably, a plurality of such apertures may be provided. These apertures may be circular in shape. Other shapes of the apertures, for example slot shape, are also envisaged.

The clearing head may include an external at least substantially annular outer cutting lip. The cutting lip may have a peripheral cutting edge for removing scale and/or debris within an internal bore of a process tapping point. To this end, the external diameter of the cutting lip may be at least substantially the same as the diameter of the internal bore of the process tapping point.

The flow path arrangement of the clearing head allows for a relatively unimpeded passage of purge fluid through the clearing head and the process tapping point. This has the advantage that the presence of a said clearing head within the process tapping point does not significantly effect the process measurements, in particular the pressure measurement, obtained from that tapping point. This is because the clearing head would provide a minimal head loss thereacross thereby resulting in a minimal effect on the pressure measurement obtained from that tapping point when the clearing head is located therein.

The clearing head may be located at the end of an elongate stem to enable the clearing head to pass through a process tapping point. The clearing head may be formed integrally with the elongate stem. This ensures that the clearing head does not inadvertently separate from the stems when within the tapping point. Nevertheless, it is also possible that the clearing head be separately formed and subsequently secured to an end of the elongate stem. The clearing head may for example be threaded onto the elongate head to allow for periodic replacement of the head. The clearing head may be locked in position on the stem for example by a grub screw.

The actuation means may include a cylinder slidably supporting a piston therein. The piston may divide the cylinder into a first and second chamber. The elongate stem may be mounted to and may be moveable together with the piston. The piston and therefore the elongate stem may be driven for reciprocal motion by alternatively supplying and extracting fluid to and from the first and second chambers. This results in the stem and the piston moving in a reciprocal manner. This therefore enables the cleaning head located at the end of the stem to be driven in a reciprocal manner.

The actuation means may utilise compressed air to drive the piston pneumatically. It is to be appreciated that alternative actuation means are envisaged. For example the actuation means may alternatively be provided by hydraulic fluid or may be driven by an electrically actuated means.

According to a preferred embodiment of the apparatus according to the present invention, the apparatus may include a valve section having a tapping point connection for supporting the apparatus at a process tapping point. This valve section may include valve means for selectively isolating or allowing access to the tapping point. The isolation valve may be typically in the form of a ball valve. Alternatively, the isolation valve could be a full-bore gate valve. The use of other types of valves is also envisaged.

The actuation means and the clearing head may be provided on a separate actuator section of the apparatus. This actuator section may be mountable to the valve section of the apparatus. The isolation valve may be closed to close off access to the tapping point when the actuation section is removed or prior to installation of the actuation section. Once the actuator section is secured to the valve section, the valve can be opened to allow the clearing head to pass therethrough to gain access into the tapping point. The isolation valve can be closed if the actuator section needs to be removed. This arrangement provides for improved safety because the tapping point can be isolated from the actuation section if the actuation section needs to be separated from the valve section for replacement or servicing.

The actuation sections may further include a seal arrangement separate from the cylinder for providing an external seal for the elongate stem. This facilitates the use of "off the shelf" cylinders for this apparatus.

The actuation section may also include manual retraction means for allowing the manual retraction of the clearing head from the process tapping point. This may be necessary, for example, where there has been a malfunction in the power supply or the compressed air supply system, or where the clearing head is jammed within the tapping point. The manual actuation means may include a second elongate stem extending from the opposing side of the piston to the stem supporting the clearing head. The second elongate stem may extend from the cylinder and may have a manual extracting collar or pin located at the end thereof. This enables a manual retraction tool to be attached to the second stem to enable the tool to pull on the stem and extract the clearing head from the process tapping point. The second stem may be accommodated within a stem cover extending from the actuator section. This second stem may also provide a visual indication of the degree of movement of the clearing head located on the opposing stem.

According to another preferred embodiment, the manual actuation means may be provided by a hollow elongate stem supporting the clearing head, and a manual extractor at least partially accommodated within the hollow stems. The manual actuator may include an extractor drive shaft having a threaded outer surface, an extractor drive coupling at one end of the drive shaft and an extractor column having a threaded surface supported on the drive shaft. Rotation of the drive shaft will result in engagement of the extractor collar to the hollow stem resulting in a pulling force being applied to the stem.

The actuator section may also include means for indicating any leakage of process fluid into the apparatus. The indication means may include an annular cavity located about a portion of the stem. A weep hole may extend from the annular cavity to the exterior of the apparatus. The annular cavity may be located within the process connection of the actuator section. The weep hole may extend to the outer surface of the process connection. Any leakage of the process fluid through the seal means of the connection can accumulate within the annular cavity and subsequently escape through the weep hole. This provides the visual indication of leakage within the apparatus.

The apparatus may be permanently installed on a process tapping point and may be automatically actuated on a periodic basis to reduce possible scale or debris build-up in that tapping point.

The use of the apparatus according to the present invention will therefore minimise or eliminate the need to do any manual clearing of the tapping point. The overall accuracy of the process measurements obtained from the tapping points will also be improved where the apparatus is being used.

Although purge fluid is still required to be used with the apparatus, the volume of purge fluid required is significantly less than that required where no such apparatus according to the present invention is being used.

BRIEF DESCRIPTION OF THE DRAWINGS

It will be convenient to further describe the invention with respect to the accompanying drawings which illustrate preferred embodiments of the process tapping point clearing apparatus according to the present invention. Other arrangements of the invention are possible, and consequently, the particularity of the accompanying drawings is not to be understood as superceding the generality of the preceding description of the invention.

In the drawings;

FIGS. 1*a* and 1*b* are respective end and side cross-sectional views of the process tapping point clearing apparatus according to a first preferred embodiment of the present invention;

FIG. 2 is a detailed view of a manual retractor tool for the apparatus of FIGS. 1*a* and 1*b;*

DETAILED DESCRIPTION

Figure 3B:
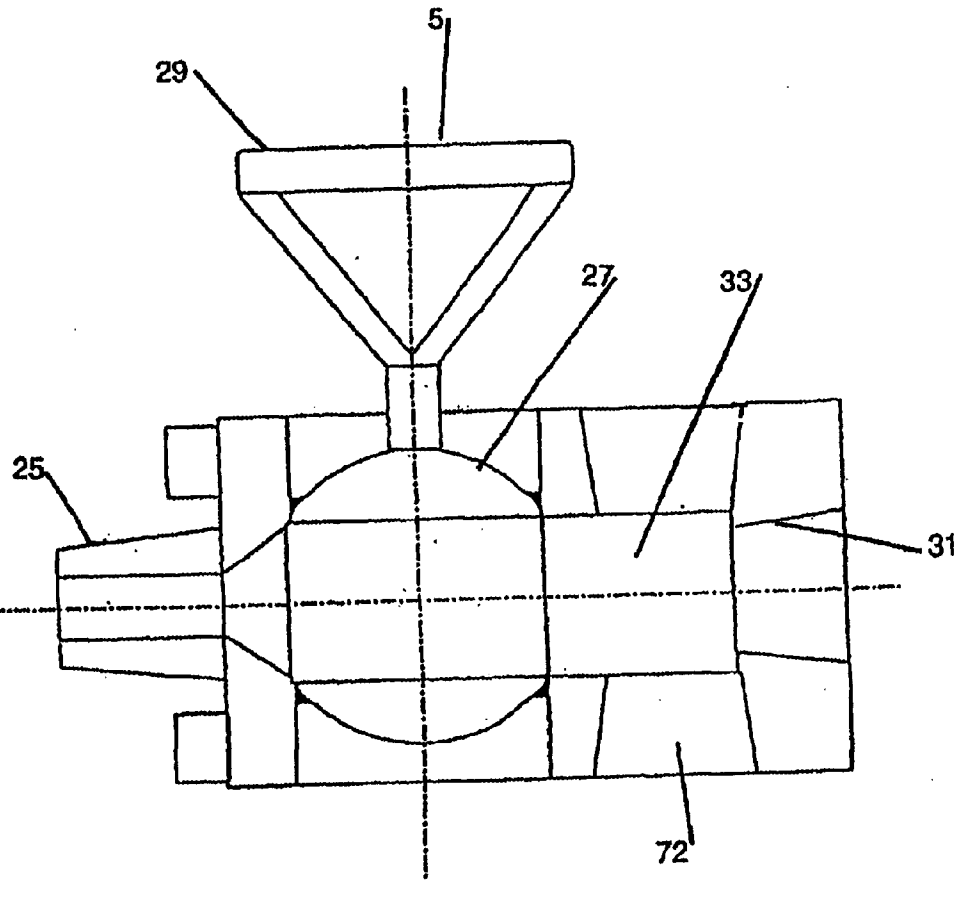
FIGS. 3*a* and 3*b* are respective end and side cross-sectional views of the valve section of the apparatus of FIGS. 1*a* and 1*b;*

Referring initially to FIGS. 1*a* and 1*b*, there is shown a process tapping point clearing apparatus 1 according to a first preferred embodiment of the present invention. This apparatus includes a valve section 5 (shown in more detail in FIGS. 3*a* and 3*b*), and an actuator section 7 (shown in more detail in FIGS. 4*a* and 4*b*).

The actuator section 7 includes an outer cylinder 9 supporting a piston 11 therein. This piston separates the cylinder into first and second fluid chambers 13, 15. The piston 11 supports an elongate stem 17 that extends from opposing sides of the piston 11. One end of the stem 17 supports a clearing head 3 (shown in more detail in FIGS. 5*a* and 5*b*, and 6*a* and 6*b*). The piston 11 and the stem 17 supported thereon can be moved in a reciprocal manner by alternately supplying or drawing compressed air from the first and second chambers 13, 15. This enables the clearing head 3 to pass through the valve section 5 into a process tapping point (not shown) to which the apparatus 1 can be mounted. The other end of the stem 17 away from the clearing head 3 extends into a stem cover 19. This end of the stem 17 includes a manual extracting collar 21. This manual extracting collar 21 can be coupled to a manual retractor tool 23 shown in FIG. 2. This allows the clearing head 3 to be manually extracted from a process tapping point, for example, where there has been a malfunction in the compressed air supplied to the actuator section 7 or where the clearing head has been jammed therein.

The manual retractor tool 23 includes an inner tube 26 having an outer threaded surface 24, and a nut 28 threaded to the inner tube 26. The retractor tool 23 can be sided into the stem enclosure 19, and the inner tube 26 will have means to engage the manual extracting collar 21. This may be in the form of an aperture which can in one position allow the collar 21 to be accommodated within the inner tube 26. Turning of the inner tube 26 will then retain the collar 21 within the tube 26 so that the retractor tool can pull the stem 17. This is achieved by turning the nut 28 to progressively displace the inner tube 26 and therefore withdrawn the stem 17 therefrom. There can be a sudden release of pressure once the clearing head 3 is extracted from the tapping point. This can lead to a sudden rearward motion of the stem. This motion will however be accommodated within the confines of the inner tube 26 to minimize any danger to the operator.

Figure 3A:
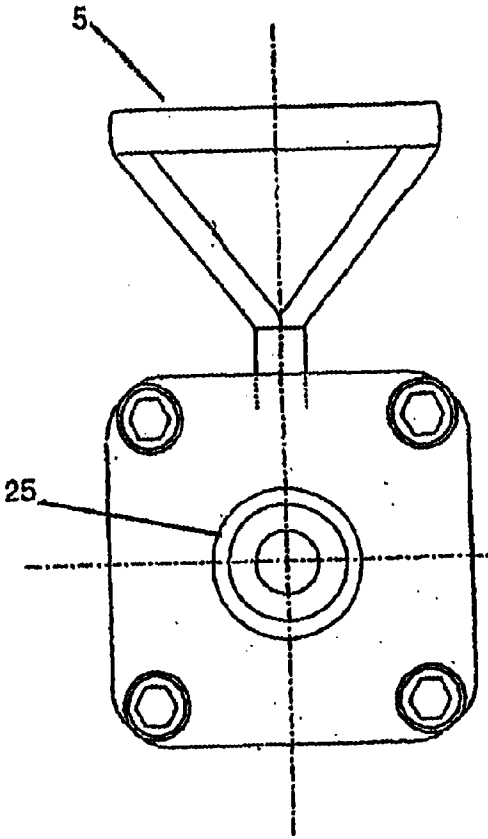

FIGS. 3*a* and 3*b* show in more detail the valve section 5. This valve section includes a tapping point connection 25. This connection 25 is threaded and engages the hole normally provided for each process tapping point. The valve section 5 further includes a ball type isolation valve 27 which is rotated by means of a handle 29. At the other end of the valve section 5 is provided a connection bore 31 for connecting the actuator section 7 to the valve section 5. The ball valve 27 can be rotated to provide a continuous passage 33 through which the stem 17 and cleaning head 3 can pass. Also located on the valve section 5 is a vent/drain plug 35 (shown in FIG. 1*b*) and an impulse line connection 72. The vent/drain plug 35 can be used to release any fluid trapped within the valve section when the ball valve 27 has been closed. This may be required where any calibration check of the measurement system is being done. The impulse line connection is where the process measurement lines are connected to the apparatus.

Figures 4A, 4B:
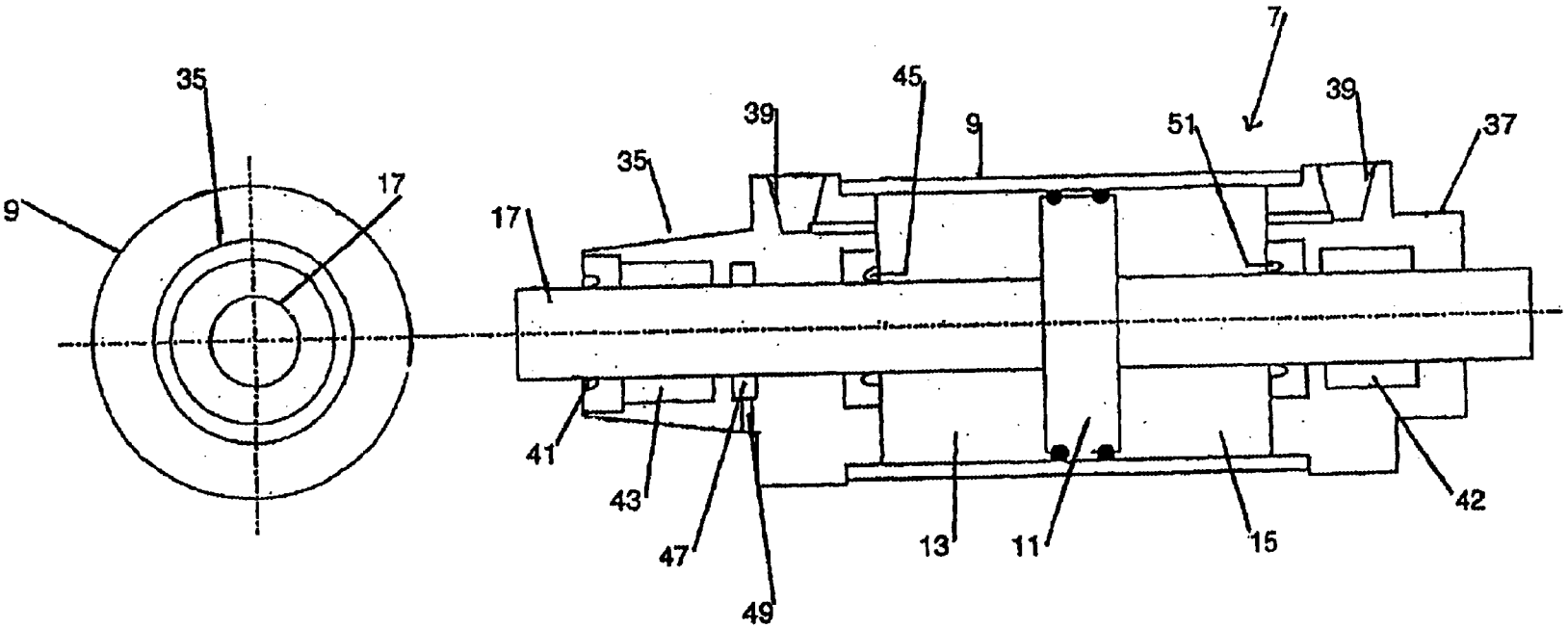
FIGS. 4*a* and 4*b* are respective end and side cross-sectional views of the actuator section of the apparatus of FIGS. 1*a* and 1*b;*

FIGS. 4*a* and 4*b* show in more detail the features of the actuator section 7. At opposing ends of the cylinder 9 is respectively provided a process connection 35 and a stem cover connection 37. The process connection 35 can be connected to the connection bore 31 of the valve section 5. Both the process connection 35 and stem cover connection 37 respectively accommodate air connections 39 for connecting to a compressed air supply. This enables compressed air to be delivered to both the first and second chambers 13, 15.

When the ball valve 27 is open, the process connection 35 is exposed to the process fluid. Therefore, the process connection 35 includes a series of seals and bearings to prevent the leakage of process fluid therefrom. These include a process cup seal 41 at the external end of the process connection 35. This process cup seal 41 provides a seal about the stem 17. This stem 17 is also supported on a bearing 43 provided behind the process cup seal 41. A cylinder cup seal 45 is provided at the opposing end of the process connection 35 to provide a further seal about the stem 17. Furthermore, an annular cavity 47 is provided about the stem 17. In fluid communication with the annular cavity 47 is a weep hole 49. This weep hole 49 provides a visual indication of any leakage of process fluid through the process connection 35 which would be collected within the annular cavity 47.

The stem cover connection 37 is similarly provided with a cup seal 51 about the stem 17 to prevent the loss of air from the second chamber 15. A bearing 42 is provided in the stem cover connection 37 to support the stem 17. The stem cover 19 can be secured to the stem cover connection 37. The stem cover 19 includes an opening that exposes the manual extracting head 21 of the stem 17 to thereby allow for manual extraction of the clearing head as so required.

Figure 5B:
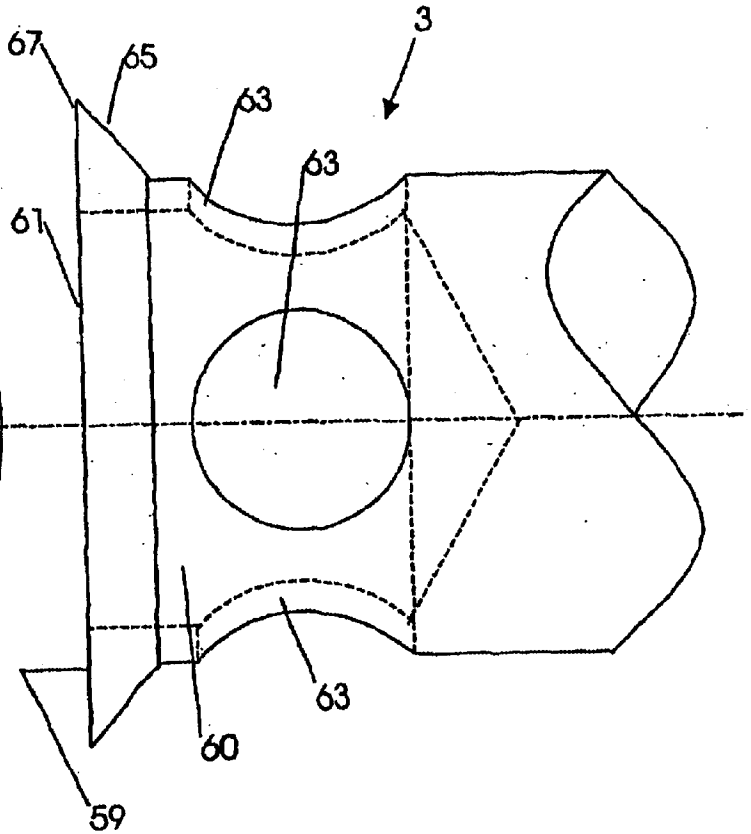
FIGS. 5*a* and 5*b* are respective end and side views of a first preferred embodiment of the clearing head according to the present invention adapted for the scraping of scale.
Figure 5A:
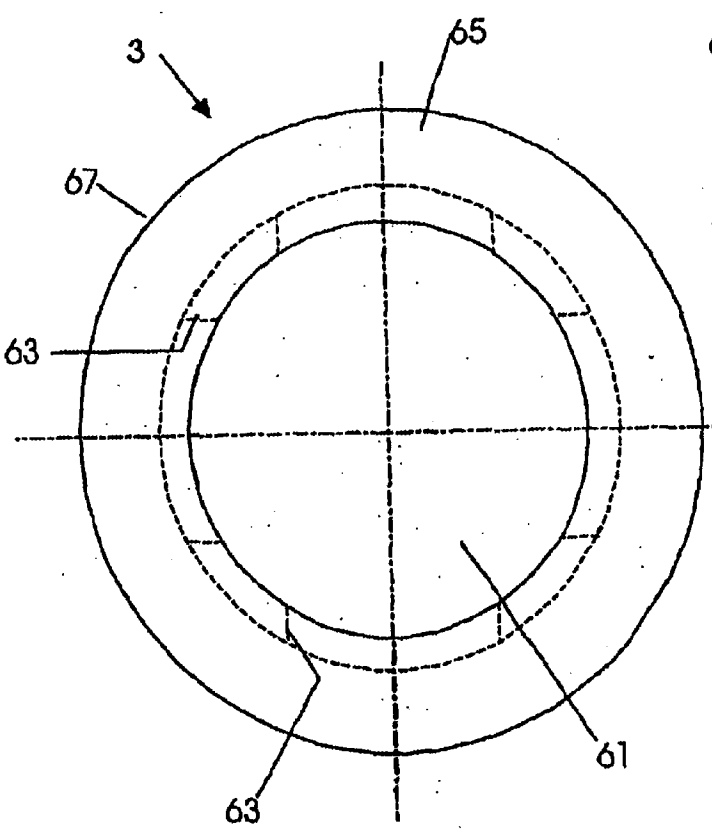
Figure 6B:
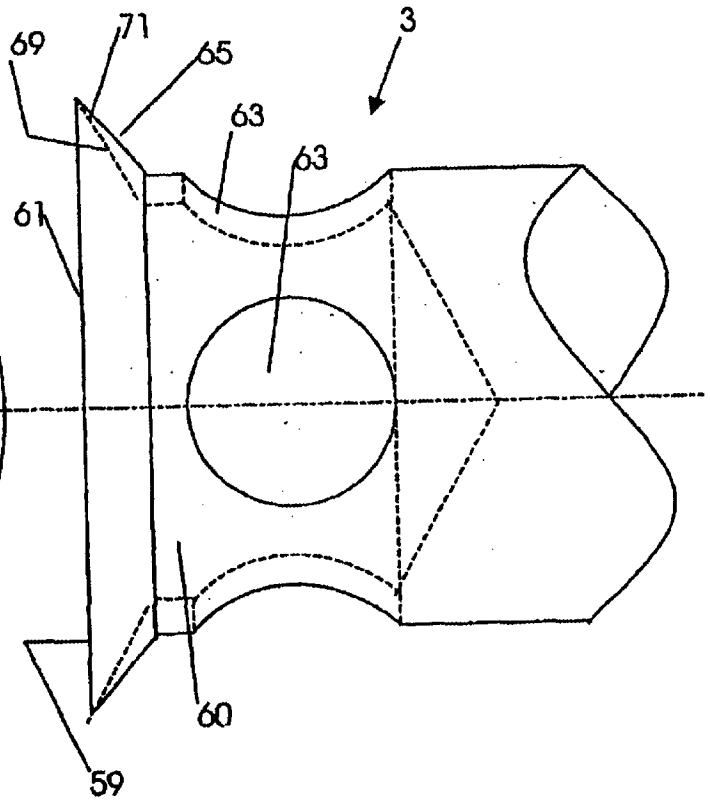
FIGS. 6*a* and 6*b* are respective end and side views of a first preferred embodiment of a clearing head according to the present invention adapted for the removal of fibrous material.
Figure 6A:
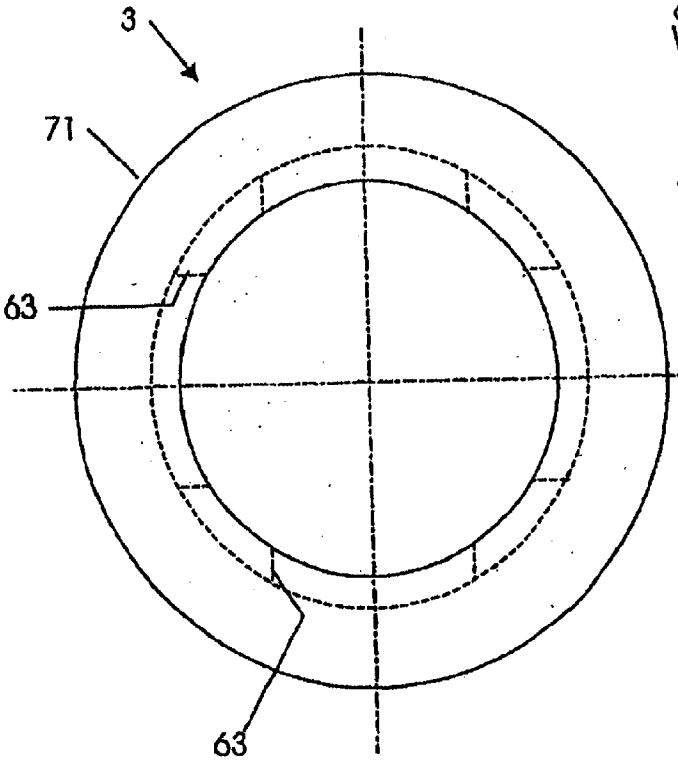

FIGS. 5*a* and 5*b* show a first preferred embodiment of a clearing head 3 according to the present invention. The clearing head 3 includes an internal cavity 60 which is shown as a cylindrical bore extending from the end face 59 of the clearing head 3. The cavity 60 therefore provides an external opening 61 through which purge fluid can flow through. A series of apertures 63 are provided about the periphery of the clearing head 3 to allow purge fluid to flow into and through the cavity 60 and out through the access opening 61.

The clearing head 3 further includes an annular cutting skirt 65 having a circular cutting edge 67 about its periphery. The diameter of the cutting skirt 65 can be sized to correspond with the bore of the process tapping point.

The clearing head 3 shown in FIGS. 5*a* and 5*b* is specifically adapted for scraping scale from the inner bore of the process tapping point. The second preferred embodiment of the clearing head 3 shown in FIGS. 6*a* and 6*b* includes all the same features of the clearing head of FIGS. 5*a* and 5*b*. The principal difference is that this clearing head 3 is specifically adapted for the removal of fibrous material from a process tapping point. Therefore, the cutting skirt 65 has a somewhat different configuration with the internal bore 60 of the clearing head 3 having frusto-conical portion 69 located within the cutting flange 65. This produces a tapered cutting lip 71 about the periphery of the cutting flange 65. This provides a cutting edge for cutting through fibrous material.

Figure 7:
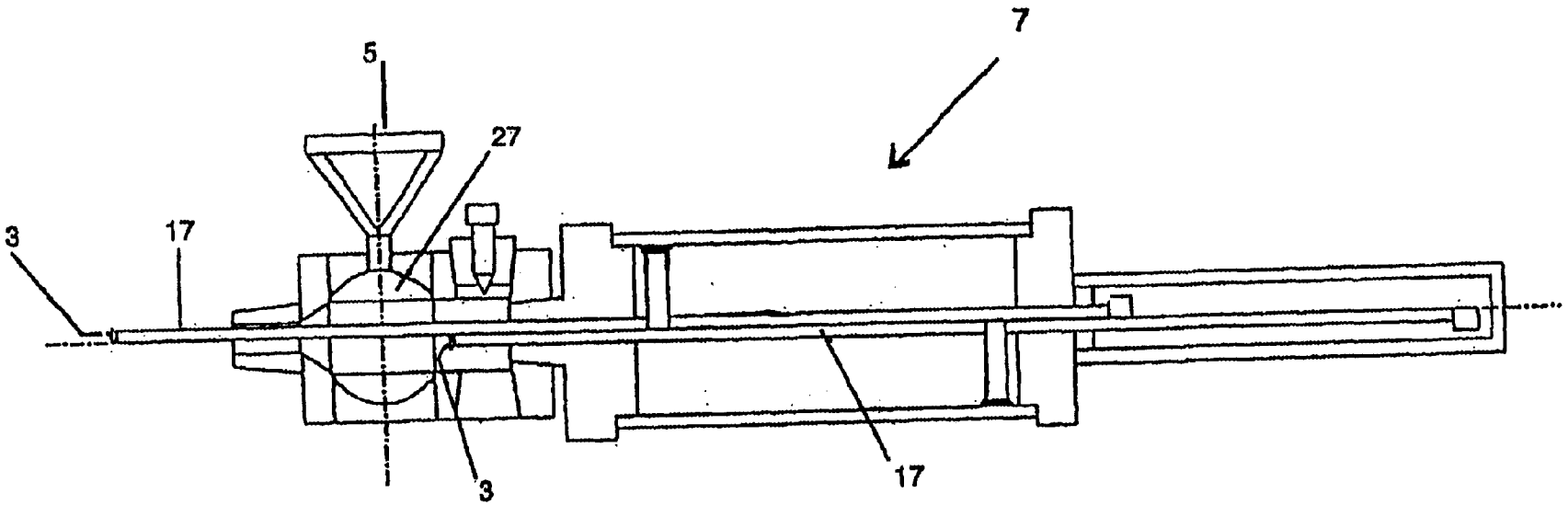
FIG. 7 is a cross-sectional view of the of FIGS. 1*a* and 1*b* showing the clearing head and stem in an extended and retracted position respectively.

FIG. 7 shows the process tapping point cleaning apparatus 1 in both an extended and retracted position. The upper half of the drawing shows the stem 17 extending through the valve sections into the process tapping point (not shown). The lower half of the drawing shows the stem 17 and the clearing head 3 in its fully retracted position. It is noted that the stem 17 when in its fully retracted position does not interfere with the movement of the isolation valve 27. This means that the valve 27 can be fully closed to prevent the flow of process fluid therethrough. The actuator section 7 can then be safely removed from the valve section 5.

Figure 8:
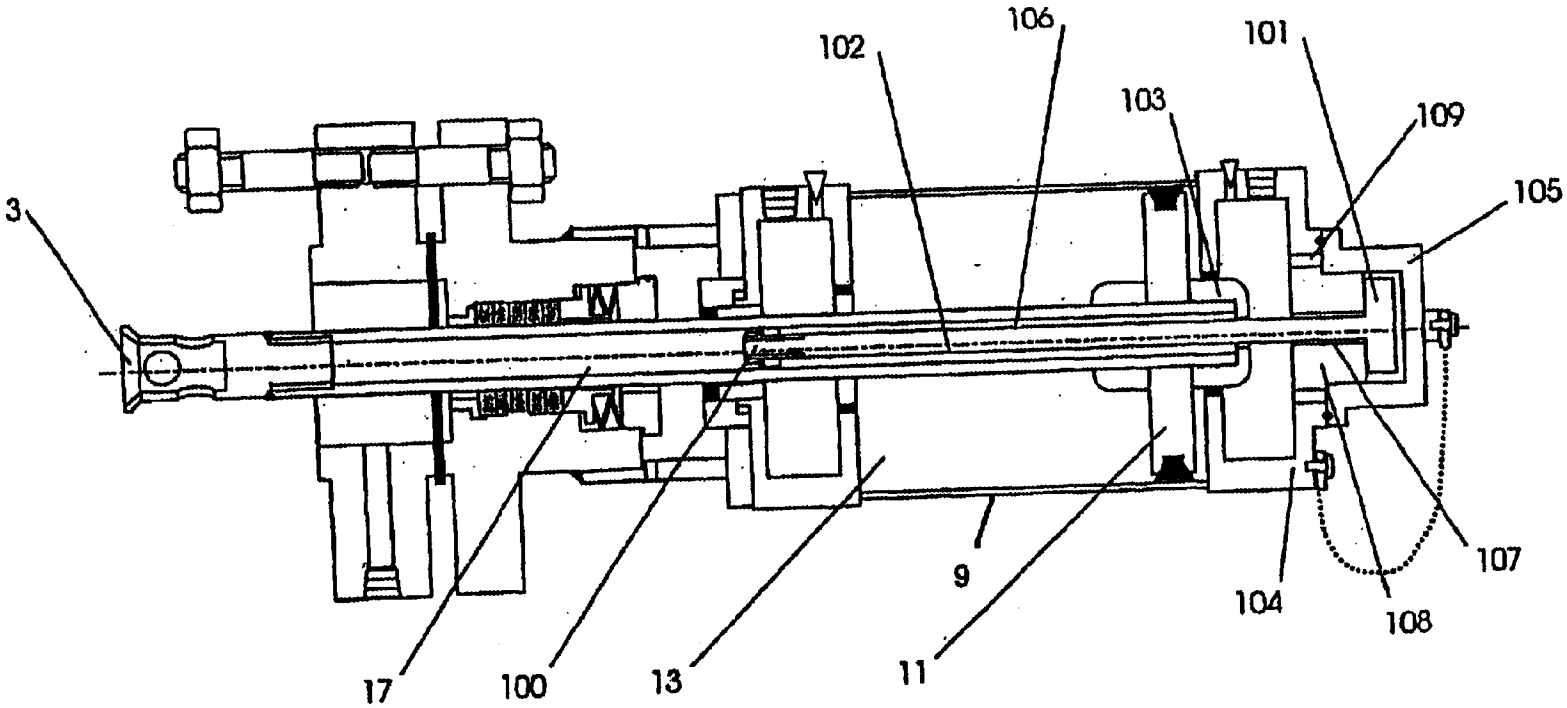
FIG. 8 is a side cross-sectional view of a second preferred embodiment of the process tapping point clearing apparatus according to the present invention, showing an alternative arrangement for the manual extractor.

FIG. 8 shows a side cross sectional view of a second preferred embodiment the process tapping point clearing apparatus according to the present invention with an alternative arrangement of the manual extractor.

The same reference numerals are used for features corresponding to the apparatus shown in FIGS. 1*a* and 1*b* for clarity purposes. The alternative arrangement of the apparatus includes a hollow elongate stem 17 with the clearing head 3 on one end and being mounted at the other end thereof on the piston 11. The manual extractor 106 includes an extractor collar 100 having an inner threaded surface located at one end of an extractor drive shaft 102, and an extractor drive coupling 101 attached to the opposing end of the extractor drive shaft 102.

The manual extractor 106 is located within the apparatus by placing the manual extractor collar 100 inside the hollow stem 17 and locating an extractor boss 103 over the other end of the hollow stem 17. Attaching the manual extractor boss 103 to the opposite end of the stem 17 to the clearing head 3, acts to retain the manual extractor collar 100 within the hollow stem 17. Once the hollow stem 17 and manual extractor collar 100 are assembled, the extractor drive shaft 102 is passes through a hole in the centre of the manual extractor boss 103 and the extractor drive shaft 102 has an external thread which couples to the internal thread of the manual extractor collar 100.

Thus when in operation and when the manual extractor 106 is not being used, the hollow stem 17 and manual extractor boss 103 are free to move over the manual extractor drive shaft 102 without interference. The manual extractor collar is slidably supported within the hollow stem 17. The manual extractor drive shaft 102 is prevented from, moving together with the hollow stem 17 because of the mating thread 107 in the end of the cylinder 108 coupling with the external threaded surface of the extractor drive shaft 102.

When the manual extractor 106 is used to retract the stem 17 to the retracted position, the end cap 105 is removed and, the manual extractor drive coupling 101 is rotated thus moving the manual extractor collar 100 along the manual extractor drive shaft 102. Once the manual extractor collar 100 comes into contact with the manual extractor boss 103, a pulling force is applied to the hollow stem 17, and the hollow stem 17 is pulled back towards the retracted position as the manual extractor drive shaft 102 is further rotated.

To prevent damage to the manual extractor 106 when being used, the end of the cylinder 108 has vent holes 109. These vent holes 109 are exposed on removal of the end cap 105 so that when the end cap 105 is removed the cylinder 9 cannot be pressurized. This safety feature prevents damage to the manual extractor 106 by actuation of the piston 11 when the extractor drive shaft 102 is not fully home and the end cap 105 is not in place.

Figure 9:
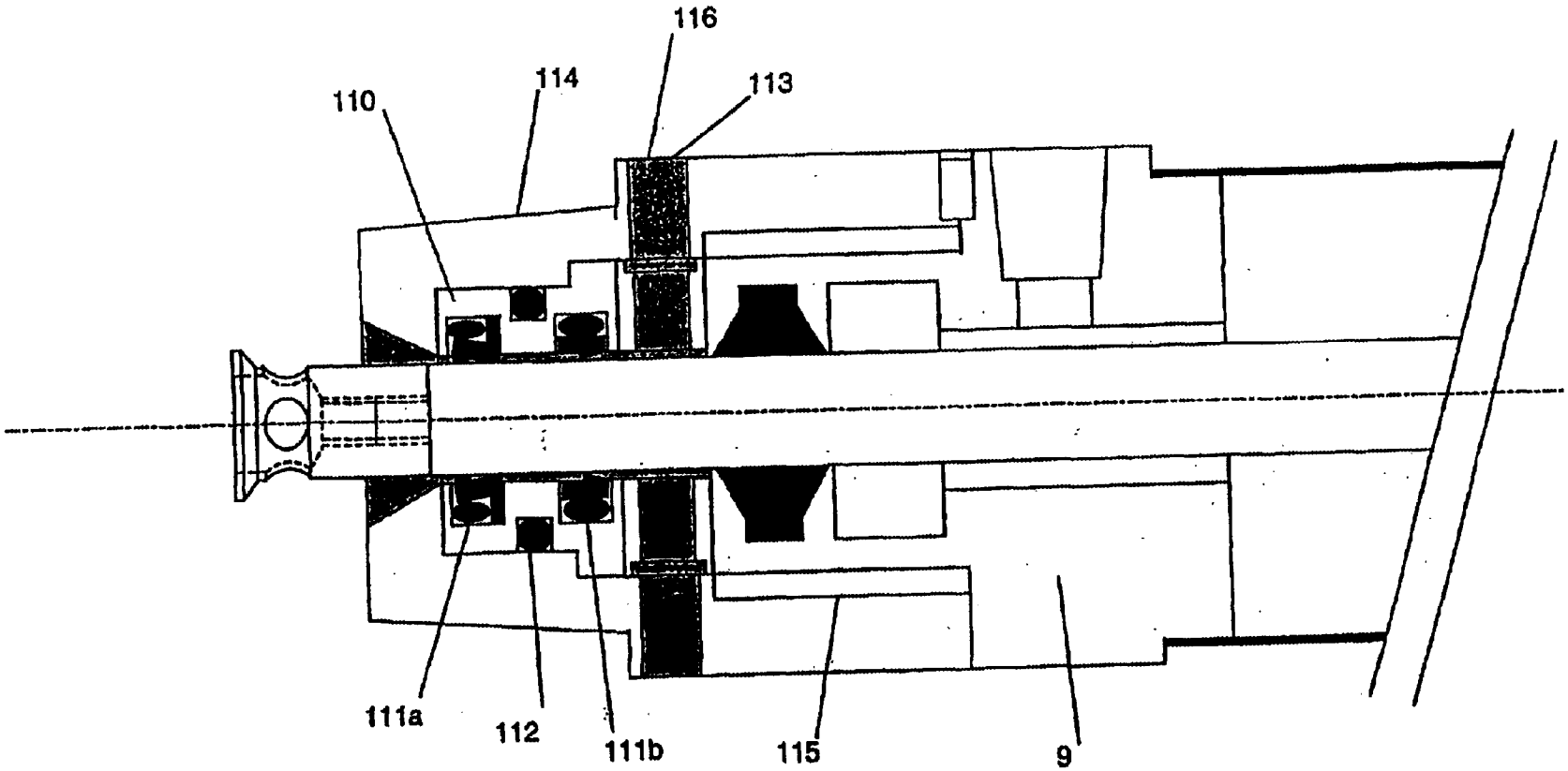
FIG. 9 is a cross sectional view of another preferred embodiment of a seal arrangement.

FIG. 9 shows an alternative preferred seal arrangement for the process tapping point clearing apparatus according to the present invention. In this embodiment the seal arrangement includes a seal cartridge 110 including inner seals 111*a, b* and outer seals 112, a lantern ring 113 and a seal housing 114 to hold all the components in place on the cylinder 9. The advantage of this arrangement is that the seal arrangement is a separate item to the cylinder. This facilitates the use of "off the shelf cylinders with the seal arrangement being produced separately.

When assembled, the lantern ring 113 is placed over the stem 17 and is located adjacent to the cylinder 9 then the seal cartridge 110 is placed over the stem 17 with at least one seal 111*a,b* in contact with the stem 17 to prevent process material being drawn into the cylinder 9. On the outer side of the seal cartridge 110 is provided the outer seal 112. When the seal housing 114 is placed over the seal cartridge 110 the outer seal 112 prevents process material from passing around the seal cartridge 110 and entering the cylinder 9. The seal housing 114 is attached to the cylinder 9 by means of a mating thread 115.

The lantern ring 113 is equiped with a number of bleed holes 116 so that should process material get past the seals 111, 112 then process material should pass through the bleed holes 116 and alert the operator to failure of the seals 111, 112 and that there is process material in contact with the cylinder 9.

It would be usual to have more than one seal 111 in contact with the stem 17, particularly due to the corrosive nature of a large number of process materials and the stem 17 regularly moving relative to the seals 111. In one embodiment two seals 111 are present. These seals 111 can be manufactured form a range of materials that are chosen to be non reactive with the process material and are arrange with a wiper seal 111*a* closest to the process tapping point is used to remove process material from the stem 17 and a pressure seal 111*b* closest to the cylinder 9 is used to prevent the process material from entering the cylinder 9

Figure 10:
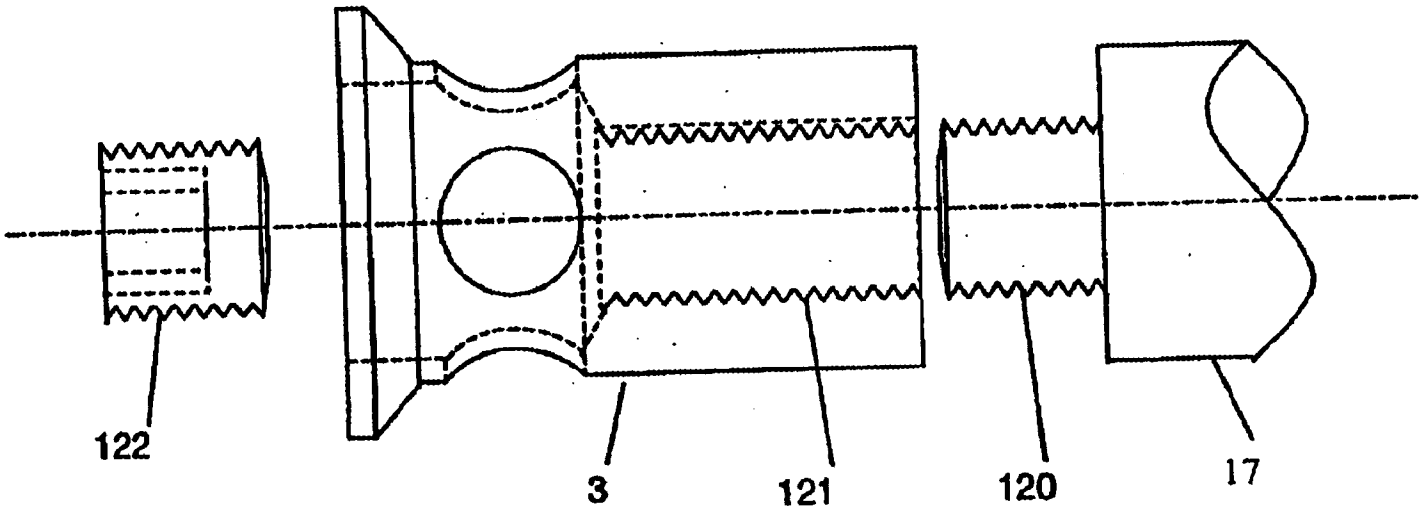
FIG. 10 is a cross-sectional view of a third preferred embodiment of a clearing head for the apparatus according to the present invention.

FIG. 10 is a cross sectional view of an alternative arrangement of the clearing head 3. The alternative arrangement for the clearing head 3 allows for removal of the clearing head 3 from the stem 17. This is provided for by a thread 120 on the stem 17 and a matching thread 121 on the clearing head 3 The clearing head 3 is threaded onto the stem 17 and is locked by grub screw 122. The use of grub screw 122 is particularly important in situations where preventing the loss of the clearing head 3 is important, for example where safety issues, arise down stream should trapped material be present in the feed or where product quality could be adversely effected.

The use of a process tapping point apparatus according to the present invention leads to a number of advantages.

- The installation of the apparatus will prevent or decrease the frequency with which manual process tapping point clearing is required.
- The installation of the apparatus will increase the overall accuracy of a process measurement.
- The installation of the apparatus will increase the availability of a process measurement.
- The installation of the apparatus will decrease the volume of purge material required.
- The apparatus will have no effect upon the process variable being measured via the tapping point. The clearing head is designed to allow a relatively unimpeded flow of purge fluid therethrough thereby avoiding an increase of pressure on the measuring instrument and a subsequent false and misleading measurement.
- The apparatus can be programmed to operate at a frequency best suited to the specific application into which it has been installed.
- The apparatus reduces the need for periodic maintenance inspections and can operate without constant supervision.

Modifications and variations as would be deemed obvious to the person skilled in the art are included within the ambit of the present invention.

I claim:

1. An apparatus for clearing a process tapping point including:

a clearing head adapted to pass through the process tapping point to remove scale and/or debris material therefrom; and actuation means for driving the clearing head in a reciprocal motion through said process tapping point;

wherein the clearing head includes a flow path through which purge fluid can pass.

2. A process tapping point clearing apparatus according to claim 1, wherein the flow path includes an internal cavity in the clearing head.

3. A process tapping point clearing apparatus of claim 2, wherein the cavity has an opening at a first end of the clearing head.

4. A process tapping point clearing apparatus according to claim 3, wherein the flow path further includes at least one aperture joining the cavity with an exterior portion of the clearing head such that purge fluid is passed through at least one aperture into the cavity and out of the opening.

5. A process tapping point clearing apparatus according to claim 4, wherein there is more than one aperture joining the cavity and exterior of the clearing head.

6. A process tapping point clearing apparatus of claim 1, wherein the clearing head includes an external at least substantially annular outer cutting lip.

7. A process tapping point clearing apparatus according to claim 6, wherein the cutting lip has a peripheral cutting edge for removing scale and/or debris within an internal bore of a process tapping point.

8. A process tapping point clearing apparatus according to claim 6, wherein said cutting lip has an external diameter which is substantially the same as the diameter of the internal bore of the process tapping point.

9. A process tapping point clearing apparatus of claim 1 wherein the flow rate in said clearing head allows for a relatively unimpeded passage of purge fluid therethrough when located within the process tapping point.

10. A process tapping point clearing apparatus of claim 1 wherein the clearing head is located at the end of an elongate stem to enable the clearing head to pass through a process tapping point.

11. A process tapping point clearing apparatus according to claim 10, wherein the clearing head is formed integrally with the elongate stem.

12. A process tapping point clearing apparatus according to claim 10, wherein the clearing head is separably mounted on the elongate stem.

13. A process tapping point clearing apparatus of claim 1 wherein the actuation means includes a cylinder slidably supporting a piston therein, the piston dividing the cylinder into a first and second chamber.

14. A process tapping point clearing apparatus according to claim 13, wherein the elongate stem is mounted to and is moveable together with the piston.

15. A process tapping point clearing apparatus according to claim 14 wherein the piston and the elongate stem mounted thereon and clearing head are driven for reciprocal motion by alternatively supplying and extracting fluid to and from the first and second chambers.

16. A process tapping point clearing apparatus according to claim 13, wherein the actuation means further includes a seal arrangement separable from the cylinder for providing an external seal for the elongate stem.

17. A process tapping point clearing apparatus of claim 1, wherein the apparatus includes a valve section having a tapping point connection for supporting the apparatus at a process tapping point.

18. A process tapping point clearing apparatus of according to claim 17, wherein the actuation means and the clearing head are provided on an actuator section of the apparatus separate to the valve section.

19. A process tapping point clearing apparatus of claim 1 wherein the actuation means includes manual retraction means for allowing the manual retraction of the clearing head from the process tapping point.

20. A process tapping point clearing apparatus of claim 1 wherein the actuation means includes means for indicating any leakage of process fluid into the apparatus.

21. An apparatus for clearing a process tapping point including:

a clearing head adapted to pass through the process tapping point to remove scale and/or debris material therefrom; and actuation means for driving the clearing head in a reciprocal motion through said process tapping point;

wherein the clearing head includes a flow path through which purge fluid can pass, and the process tapping point clearing apparatus restricts the process fluids from exiting through the process tapping point.

* * * * *